US009404358B2

(12) United States Patent
Steele

(10) Patent No.: US 9,404,358 B2
(45) Date of Patent: Aug. 2, 2016

(54) WIPER PLUG FOR DETERMINING THE ORIENTATION OF A CASING STRING IN A WELLBORE

(71) Applicant: Halliburton Energy Services, Inc., Houston, TX (US)

(72) Inventor: David Joe Steele, Arlington, TX (US)

(73) Assignee: HALLIBURTON ENERGY SERVICES, INC., Houston, TX (US)

( * ) Notice: Subject to any disclaimer, the term of this patent is extended or adjusted under 35 U.S.C. 154(b) by 0 days.

(21) Appl. No.: 14/330,555

(22) Filed: Jul. 14, 2014

(65) Prior Publication Data

US 2015/0083410 A1 Mar. 26, 2015

(30) Foreign Application Priority Data

Sep. 26, 2013 (WO) ..... PCT/US2013/061813

(51) Int. Cl.
*E21B 47/024* (2006.01)

(52) U.S. Cl.
CPC ..... *E21B 47/024* (2013.01)

(58) Field of Classification Search
CPC ..... E21B 47/0001; E21B 47/09
USPC ..... 166/336, 250.01, 255.1–225.3, 179, 166/177.3; 340/853.1, 853.8; 702/6
See application file for complete search history.

(56) References Cited

U.S. PATENT DOCUMENTS 3,326,008 A * 6/1967 Baran et al. ..... 405/184
5,667,023 A * 9/1997 Harrell et al. ..... 175/45
6,173,773 B1 1/2001 Almaguer et al.
6,244,361 B1 6/2001 Comeau et al.
6,340,063 B1 * 1/2002 Comeau et al. ..... 175/61
6,378,607 B1 * 4/2002 Ryan et al. ..... 166/255.2
6,419,012 B1 * 7/2002 George et al. ..... 166/117.6
6,419,023 B1 * 7/2002 George et al. ..... 166/373
6,474,415 B1 * 11/2002 Ohmer ..... 166/297
6,497,288 B2 * 12/2002 George et al. ..... 166/377
6,789,619 B2 9/2004 Carlson et al.
6,868,909 B2 * 3/2005 Murray ..... 166/298
7,040,420 B2 * 5/2006 Vail, III ..... 175/171
8,011,448 B2 * 9/2011 Tulloch et al. ..... 175/45
8,286,708 B2 * 10/2012 Assal et al. ..... 166/313
8,342,242 B2 1/2013 Roddy et al.

(Continued)

OTHER PUBLICATIONS

Forbes et al.; Applications of Gravity Based Measurement-While-Drilling Real-Time Azimuthal Surveys in Areas of Magnetic Interference; American Association of Drilling Engineers, 2009 National Technical Conference & Exhibition, New Orleans, Louisiana; (2009).

(Continued)

*Primary Examiner* — Matthew R Buck
*Assistant Examiner* — Aaron Lembo
(74) *Attorney, Agent, or Firm* — Haynes and Boone, LLP

(57) ABSTRACT

A system for determining the orientation of a casing string in a wellbore. The system includes a downhole tool disposed interiorly of the casing string in a known orientation relative to at least one feature of the casing string. A sensor module is operably associated with the downhole tool and is configured to obtain data relating to the orientation of the casing string. A communication module is operably associated with the sensor module. The communication module is configured to transmit information to a surface location, wherein, the information corresponds to the data obtained by the sensor module relating to the orientation of the casing string.

17 Claims, 9 Drawing Sheets

(56) References Cited

U.S. PATENT DOCUMENTS

| | | | | |
|---|---|---|---|---|
| 8,464,784 | B2 * | 6/2013 | Zupanich | 166/50 |
| 8,469,119 | B2 * | 6/2013 | Zupanich | 175/69 |
| 8,651,177 | B2 * | 2/2014 | Vail et al. | 166/87.1 |
| 8,720,553 | B2 * | 5/2014 | Tips et al. | 166/250.15 |
| 8,789,580 | B2 * | 7/2014 | Dancer et al. | 166/117.5 |
| 8,813,840 | B2 * | 8/2014 | Zupanick | 166/245 |
| 8,833,439 | B2 * | 9/2014 | Zimmerman et al. | 166/55 |
| 8,833,451 | B2 * | 9/2014 | Steele et al. | 166/298 |
| 2001/0027866 | A1 * | 10/2001 | George | 166/313 |
| 2004/0251025 | A1 * | 12/2004 | Giroux et al. | 166/291 |
| 2005/0000691 | A1 * | 1/2005 | Giroux et al. | 166/291 |
| 2005/0269083 | A1 * | 12/2005 | Burris et al. | 166/255.2 |
| 2005/0269084 | A1 * | 12/2005 | Klimack et al. | 166/255.3 |
| 2006/0201711 | A1 * | 9/2006 | Vail, III | 175/57 |
| 2007/0181345 | A1 * | 8/2007 | Vail, III | 175/171 |
| 2008/0230273 | A1 | 9/2008 | Brooks | |
| 2008/0277163 | A1 | 11/2008 | Moriarty | |
| 2009/0199419 | A1 | 8/2009 | Hepburn | |
| 2011/0011646 | A1 * | 1/2011 | Giroux et al. | 175/61 |
| 2012/0061141 | A1 * | 3/2012 | Rossing | 175/45 |
| 2012/0103687 | A1 * | 5/2012 | Saurer | 175/45 |
| 2012/0234561 | A1 | 9/2012 | Hall et al. | |
| 2013/0087321 | A1 * | 4/2013 | Bartko et al. | 166/66 |
| 2013/0206423 | A1 * | 8/2013 | Weinstock et al. | 166/358 |
| 2013/0284458 | A1 * | 10/2013 | Dancer et al. | 166/380 |
| 2013/0327572 | A1 * | 12/2013 | Sponchia et al. | 175/61 |
| 2014/0131036 | A1 * | 5/2014 | Huval et al. | 166/255.3 |
| 2014/0144652 | A1 * | 5/2014 | Steele | 166/382 |
| 2014/0196953 | A1 * | 7/2014 | Chitwood et al. | 175/57 |
| 2014/0299311 | A1 * | 10/2014 | Zupanick | 166/52 |
| 2014/0311802 | A1 * | 10/2014 | Rasheed | 175/45 |

OTHER PUBLICATIONS

Rath et al; Amplifier/Booster Joint Positioning Framework Design for a High-Speed Wired Telemetry System in MWD/LWD Downhole Tool Environment; SPE 134504; SPE Annual Technical Conference and Exhibition, Florence, Italy; Sep. 19-22, 2010.

DynaLink Telemetry System; Halliburton Testing & Subsea Catalog; (2010).

IWC Real-Time Data Thru-Bore Access; Intelligent Well Controls Datasheet; (2013).

Int'l Search Report and Written Opinion; KIPO; PCT/US2013/061813; Jun. 20, 2014.

Patent Examination Report No. 1 issued by IP Australia regarding related Australian patent application No. 2013402086, dated May 10, 2016, 3 pages.

* cited by examiner

WIPER PLUG FOR DETERMINING THE ORIENTATION OF A CASING STRING IN A WELLBORE

CROSS-REFERENCE TO RELATED APPLICATIONS

This application claims the benefit under 35 U.S.C. §119 of the filing date of International Application No. PCT/US2013/061813, filed Sep. 26, 2013.

TECHNICAL FIELD OF THE DISCLOSURE

This disclosure relates, in general, to equipment utilized in conjunction with operations performed in relation to subterranean wells and, in particular, to a drillable wiper plug assembly having intelligent components operable for determining the orientation of a casing string in a wellbore.

BACKGROUND

Without limiting the scope of the present disclosure, its background will be described in relation to forming a window in a casing string for a multilateral well, as an example.

In multilateral wells, it is common practice to drill a branch or lateral wellbore extending outwardly from an intersection with a main or parent wellbore. Typically, once the parent wellbore casing string is installed and the parent wellbore has been completed, a whipstock is positioned in the parent wellbore casing string at the desired intersection and then a rotating mill is deflected laterally off the whipstock to form a window through the parent wellbore casing sidewall.

Once the casing window is created, the lateral wellbore can drilled. In certain lateral wellbores, when the drilling operation has been completed, a lateral wellbore casing string is installed in the lateral branch. Casing the lateral branch may be accomplished with the installation of a liner string that is supported in the parent wellbore and extends a desired distance into the lateral wellbore. Once the lateral wellbore casing string is installed and the lateral wellbore has been completed, it may be desirable to reestablish access to the main wellbore. In such cases, a rotating mill may be use to form an access window through the lateral wellbore casing sidewall.

In certain multilateral installations, it may be desirable to drill the lateral wellbore in a predetermined direction from the parent wellbore such as out of the high side of the parent wellbore. In such installations, it is necessary to form the window at a predetermined circumferential orientation relative to the parent wellbore casing. In order to properly position and rotationally orient the whipstock such that the window is milled in the desired direction, a latch assembly associated with the whipstock may be anchored into and rotationally oriented within a latch coupling interconnected in the parent wellbore casing string. The latch assembly typically includes a plurality of spring operated latch keys, each having an anchoring and orienting profile that is received in a latch profile formed internally within the latch coupling. In this manner, when the latch keys of the latch assembly are operatively engaged with the latch profile of the latch coupling, the latch assembly and the equipment associate therewith are axially anchored and circumferentially oriented in the desired direction within the parent wellbore casing string. Importantly, to obtain the proper orientation of the latch assembly, the latch coupling of the parent wellbore casing string must first be positioned in the desired orientation. One way to orient the latch coupling is to rotate the parent wellbore casing string with a drill string using measurement while drilling data. It has been found, however, that rotationally orienting the parent wellbore casing string in this manner can be imprecise and time consuming. Accordingly, a need has arisen for improved systems and methods for orienting a parent wellbore casing string in a wellbore.

BRIEF DESCRIPTION OF THE DRAWINGS

For a more complete understanding of the features and advantages of the present disclosure, reference is now made to the detailed description along with the accompanying figures in which corresponding numerals in the different figures refer to corresponding parts and in which.

DETAILED DESCRIPTION

Figure 1:
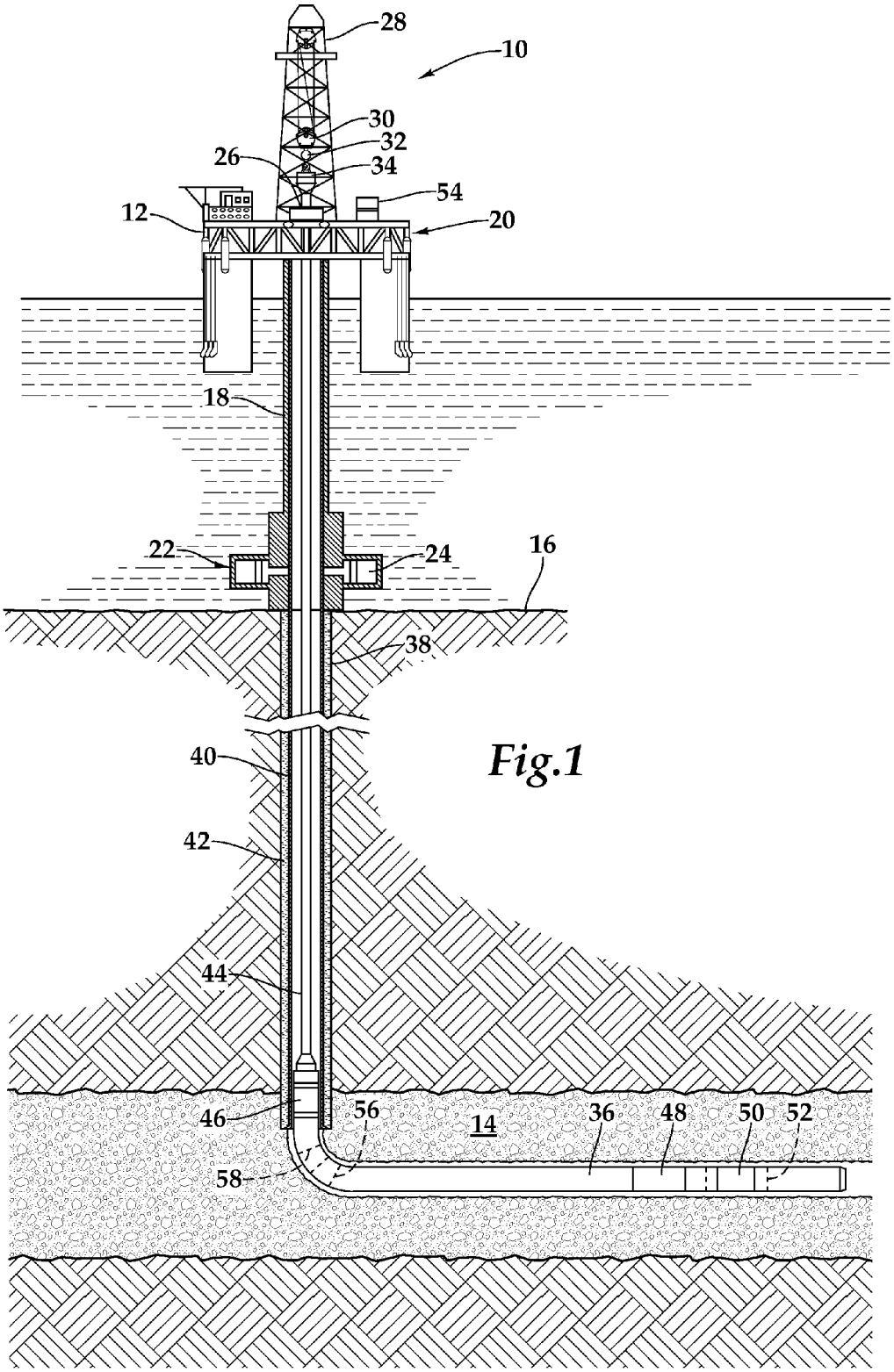
FIG. 1 is a schematic illustration of an offshore oil and gas platform installing a casing string in a subterranean wellbore according to an embodiment of the present disclosure.

While various system, method and other embodiments are discussed in detail below, it should be appreciated that the present disclosure provides many applicable inventive concepts, which can be embodied in a wide variety of specific contexts. The specific embodiments discussed herein are merely illustrative, and do not delimit the scope of the present disclosure.

In a first aspect, the present disclosure is directed to a system for determining the orientation of a casing string in a wellbore. The system includes a downhole tool disposed interiorly of the casing string in a known orientation relative to at least one feature of the casing string. A sensor module is operably associated with the downhole tool and is configured to obtain data relating to the orientation of the casing string. A communication module is operably associated with the sensor module. The communication module is configured to transmit information to a surface location, wherein, the information corresponds to the data obtained by the sensor module relating to the orientation of the casing string.

In a first embodiment, the downhole tool may be a wiper plug that is positioned in a known orientation within a latch coupling interconnected in the casing string. In this embodiment, a window joint may be interconnected in the casing string in a known orientation relative to the latch coupling. In a second embodiment, the sensor module may include one or more of an accelerometer, which may be a three-axis accelerometer, a gyroscope, which may be a three-axis gyroscope and a magnetometer, which may be a three-axis magnetometer. In a third embodiment, a microcontroller may be operably associated with the sensor module and the communication module. In a fourth embodiment, a power supply may be operably associated with the sensor module and the communication module. In a fifth embodiment, the communication module may be a pulser configured to transmit pressure pulses to the surface location.

In a second aspect, the present disclosure is directed to a system for determining an orientation of a casing string in a wellbore. The system includes a latch coupling interconnected in the casing string. A wiper plug is received within the latch coupling in a known orientation. A sensor module is disposed within the wiper plug. The sensor module includes at least one of an accelerometer, a gyroscope and a magnetometer configured to obtain data relating to the orientation of the casing string. A communication module is operably associated with the sensor module. The communication module is configured to transmit information to a surface location, wherein, the information corresponds to the data obtained by the sensor module relating to the orientation of the casing string. A microcontroller is operably associated with the sensor module and the communication module. A power supply is operably associated with the sensor module, the communication module and the microcontroller.

In a sixth embodiment, the wiper plug may sealingly engage the casing string uphole and downhole of the latch coupling. In a seventh embodiment, the wiper plug may releasably engage the latch coupling. In an eighth embodiment, wiper plug may be a drillable wiper plug.

In a third aspect, the present disclosure is directed to a method for orientating a casing string in a wellbore. The method includes disposing a downhole tool interiorly of the casing string in a known orientation relative to at least one feature of the casing string; obtaining data relating to the orientation of the casing string with a sensor module operably associated with the downhole tool; transmitting orientation information corresponding to the data obtained by the sensor module to a surface location with a communication module operably associated with the sensor module; and orienting the casing string to a desired orientation within the wellbore based upon the orientation information received at the surface location.

The method may also include disposing the downhole tool interiorly of the casing string in the known orientation relative to the at least one feature of the casing string prior to running the casing string into the wellbore; positioning a wiper plug in a known orientation within a latch coupling interconnected in the casing string; sealing engaging the casing string uphole and downhole of the latch coupling with the wiper plug; obtaining orientation data with at least one of an accelerometer, a gyroscope and a magnetometer; transmitting pressure pulses to the surface location to communicate orientation information and/or destructively removing the downhole tool from the casing string after orienting the casing string to the desired orientation within the wellbore based upon the orientation information received at the surface location.

Referring initially to FIG. 1, a liner string is being installed in a subterranean wellbore from an offshore oil or gas platform that is schematically illustrated and generally designated 10. A semi-submersible platform 12 is centered over submerged oil and gas formation 14 located below sea floor 16. A subsea conduit 18 extends from deck 20 of platform 12 to wellhead installation 22, including blowout preventers 24. Platform 12 has a hoisting apparatus 26, a derrick 28, a travel block 30, a hook 32 and a swivel 34 for raising and lowering pipe strings, such as a liner string 36.

A main wellbore 38 has been drilled through the various earth strata including formation 14. The terms "parent" and "main" wellbore are used herein to designate a wellbore from which another wellbore is drilled. It is to be noted, however, that a parent or main wellbore does not necessarily extend directly to the earth's surface, but could instead be a branch of yet another wellbore. One or more surface and intermediate casing strings 40 have been installed in an upper and generally vertical section of main wellbore 38 and have been secured therein by cement 42. The term "casing" is used herein to designate a tubular string used in a wellbore or to line a wellbore. The casing may be of the type known to those skilled in the art as a "liner" and may be made of any material, such as steel or a composite material and may be segmented or continuous, such as coiled tubing.

In the illustrated embodiment, liner string 36 is being installed in a generally horizontal section of wellbore 38. Liner string 36 is being deployed on the lower end of a work string 44. Liner string 36 includes a liner hanger 46, a window joint 48 and a latch coupling 50. Liner hanger 46 may be a conventional pressure or hydraulic set liner hanger with slips, annular seals, packers and the like to establish a gripping and sealing relationship with the interior of casing string 40 when set. Window joint 48 may be of conventional design and may include or may not include a pre-milled window. Latch coupling 50 has a latch profile that is operably engagable with latch keys of a latch assembly such that the latch assembly may be axially anchored and rotationally oriented in latch coupling 50. In conventional practice, when the primary latch key of the latch assembly operably engages the primary latch profile of latch coupling 50, a deflection assembly such as a whipstock is positioned in a desired circumferential orientation relative to window joint 48 such that a window can be milled, drilled or otherwise formed in window joint 48 in the desired circumferential direction. Once the window is formed, a branch or lateral wellbore may be drilled from window joint 48 of main wellbore 38. The terms "branch" and "lateral" wellbore are used herein to designate a wellbore that is drilled outwardly from its intersection with another wellbore, such as a parent or main wellbore. A branch or lateral wellbore may have another branch or lateral wellbore drilled outwardly therefrom.

In the illustrated embodiment, liner string 36 includes a system for determining the orientation of liner string 36 in wellbore 38. Shown in phantom lines, a wiper plug 52 is positioned to the interior of liner string 36 and is preferably received within latch coupling 50 in a known orientation such that seal elements of wiper plug 52 sealingly engage liner string 36 uphole and downhole of latch coupling 50 to protect latch coupling 50 during, for example, cementing operations. Wiper plug 52 may be run downhole positioned within liner string 36. In this case, wiper plug 36 may be mechanically coupled within latch coupling 50 at the surface or prior to delivery of latch coupling 50. Alternatively, wiper plug 52 may be conveyed downhole once the liner string 36 is landed within the wellbore 38. In either case, one or more elements of wiper plug 52 may be configured to locate within a corresponding profile or groove within latch coupling 50. Wiper plug 52 may further have one or more elements that enable release of wiper plug 52 from latch coupling 50, if desired.

As described in detail below, wiper plug 52 includes electronic components and mechanical devices that provide intelligence and communication capabilities to wiper plug 52. For example, wiper plug 52 may include a sensor module having one or more sensors such as one or more accelerometers, one or more gyroscopes, one or more magnetometers, pressure sensors, temperature sensors or the like. The sensor module is operable to obtain data relating to the orientation of liner string 36 such that liner string 36 may be circumferentially positioned within wellbore 38 with, for example, the primary latch profile of latch coupling 50 located on the high side of wellbore 38, which is the preferred orientation for exiting the window of window joint 48 for drilling the lateral branch wellbore. The information obtained by the sensor module may be transmitted to a surface installation 54 by any suitable unidirectional or bidirectional wired or wireless telemetry system such as an electrical conductor, a fiber optic cable, acoustic telemetry, electromagnetic telemetry, pressure pulse telemetry, combinations thereof or the like. Once the orientation information is received and processed by surface installation 54, work string 44 may be rotated, which in turn rotates liner string 36 until the desired orientation is obtained. The gathering of information by the sensor module and transmission of the information to surface installation 54 may occur in real-time or substantially in real-time to enable efficient orientation of liner string 36 within wellbore 38. Also shown in phantom lines, a lead wiper 56 and a follow wiper 58 are positioned to the interior of liner string 36 proximate to liner hanger 46. Together, wiper plug 52, lead wiper 56 and follow wiper 58 may be referred to collectively as a wiper plug assembly.

Even though FIG. 1 depicts a liner string being installed in a horizontal section of the wellbore, it should be understood by those skilled in the art that the present system is equally well suited for use in wellbores having other orientations including vertical wellbores, slanted wellbores, deviated wellbores or the like. Accordingly, it should be understood by those skilled in the art that the use of directional terms such as above, below, upper, lower, upward, downward, uphole, downhole and the like are used in relation to the illustrative embodiments as they are depicted in the figures, the upward direction being toward the top of the corresponding figure and the downward direction being toward the bottom of the corresponding figure, the uphole direction being toward the surface of the well, the downhole direction being toward the toe of the well. Also, even though FIG. 1 depicts an offshore operation, it should be understood by those skilled in the art that the present system is equally well suited for use in onshore operations.

Figure 2A:
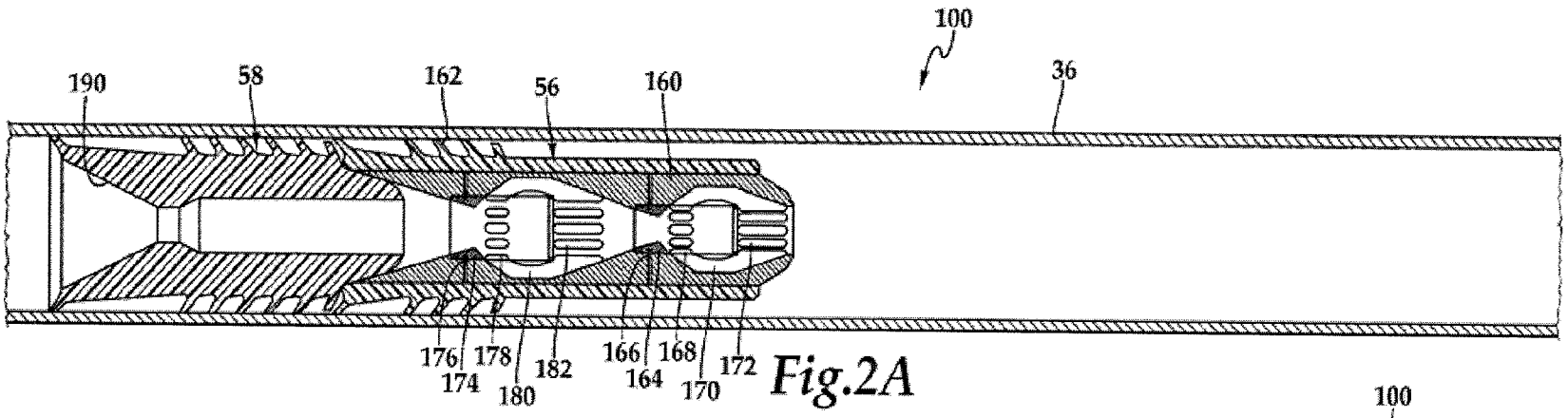
FIGS. 2A-2B are cross sectional views of a system for determining an orientation of a casing string in a wellbore according to an embodiment of the present disclosure during a casing string orientation procedure.
Figure 2B:
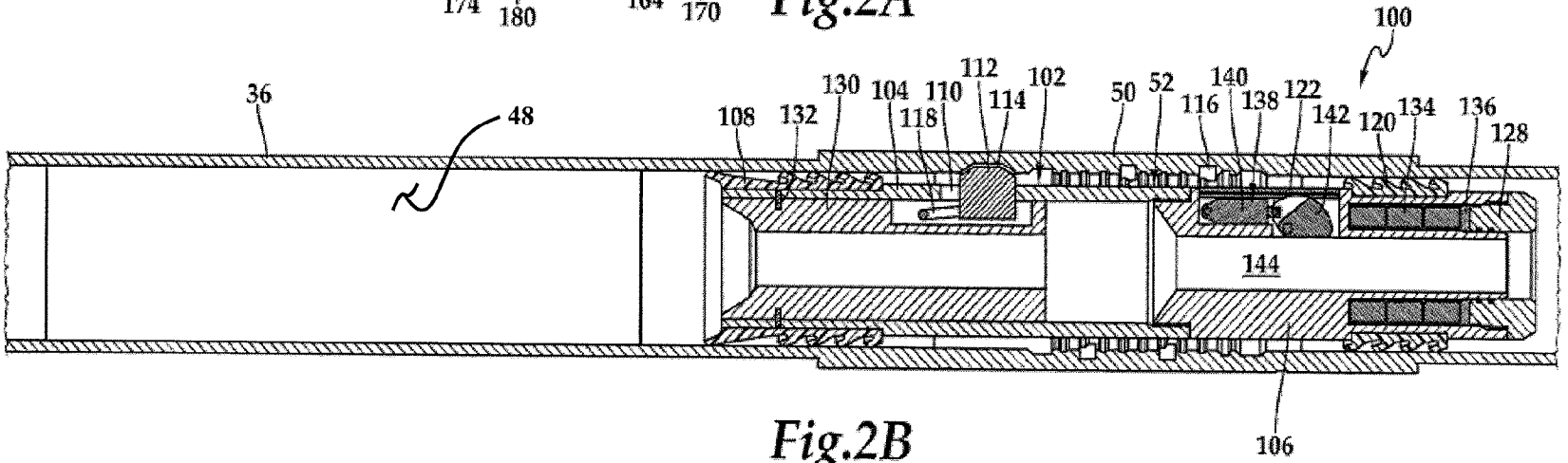
Figure 7A:
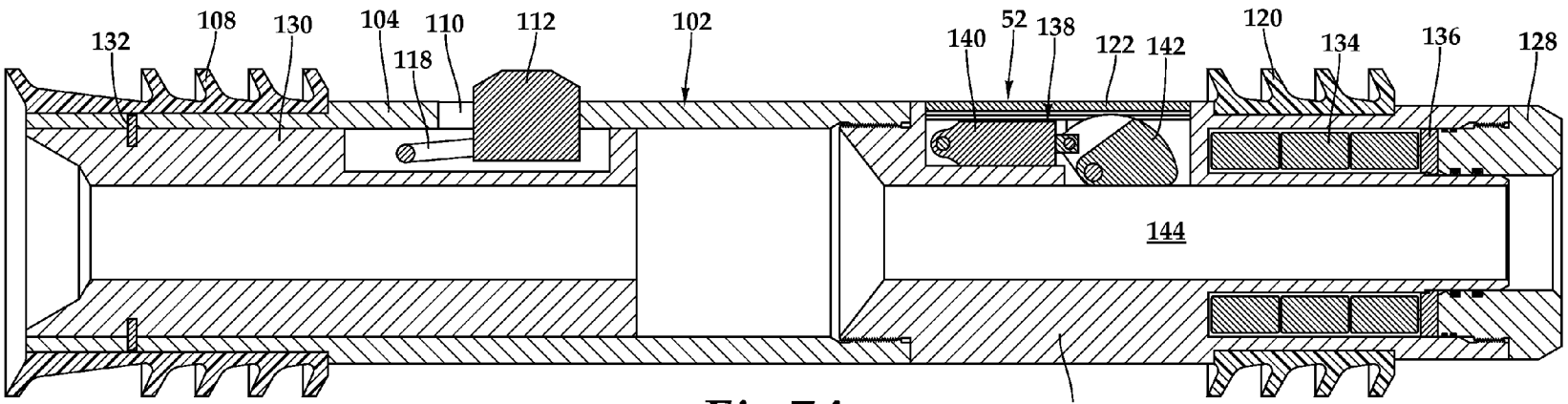
FIGS. 7A-7C are various views of a wiper plug for use in a system for determining an orientation of a casing string in a wellbore according to an embodiment of the present disclosure.
Figure 7B:
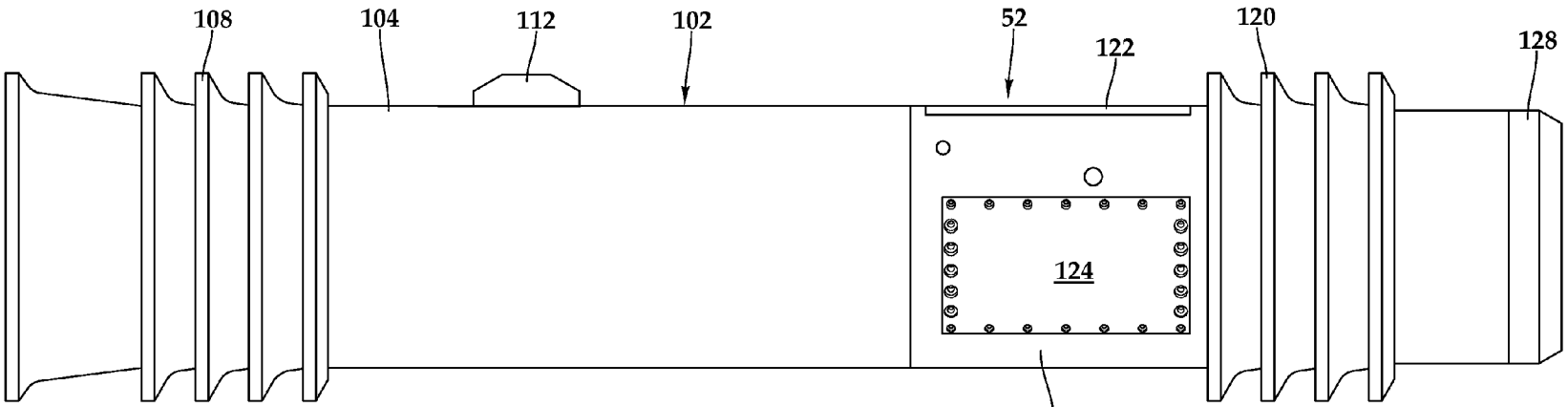
Figure 7C:
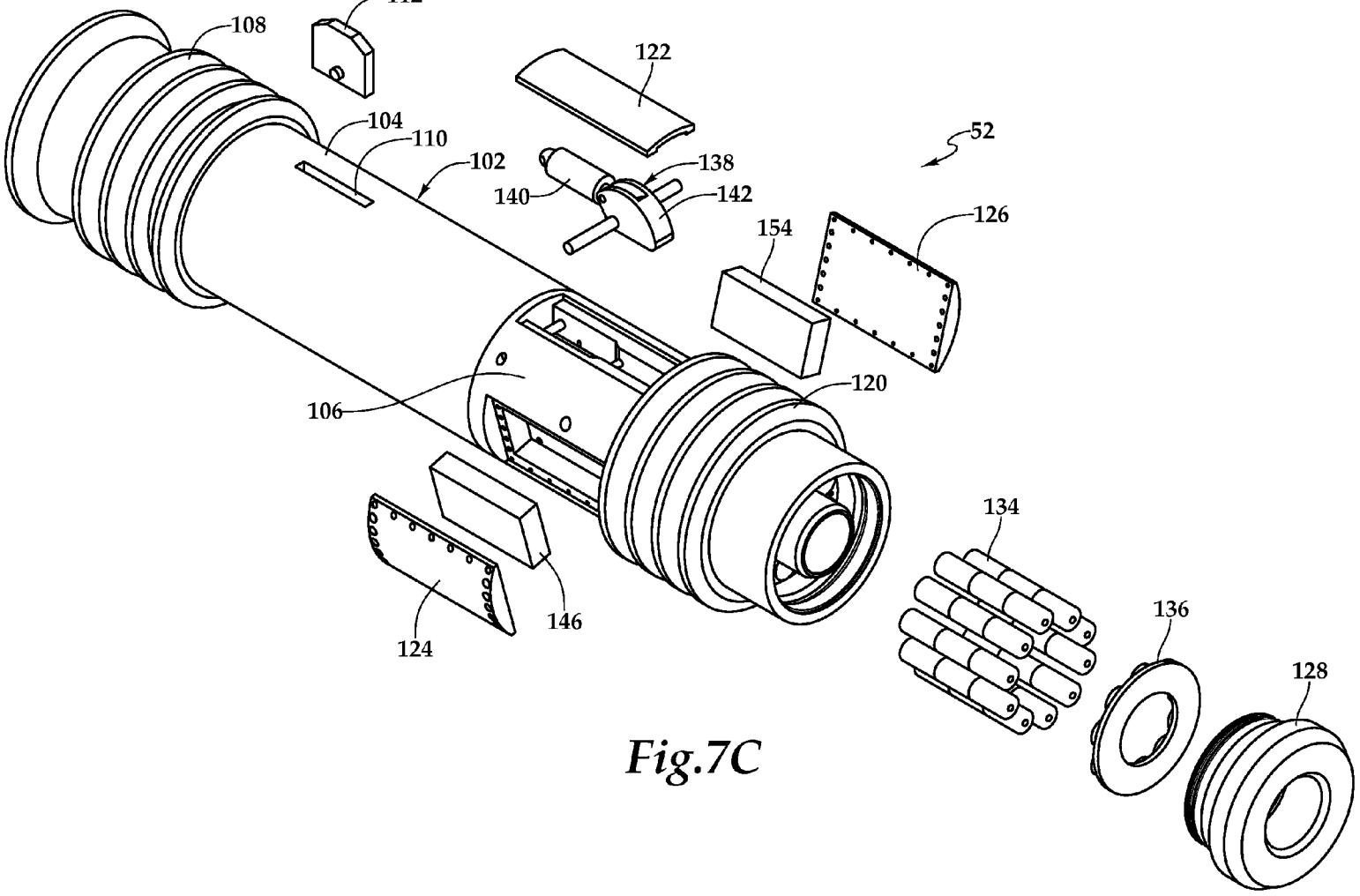

Referring next to FIGS. 2A-2B, therein is illustrated a well system that is generally designated 100. In the illustrated portions, well system 100 includes a wiper plug assembly depicted as wiper plug 52, lead wiper 56 and follow wiper 58. Wiper plug 52 has been installed within the interior of liner string 36 and more particularly, wiper plug 52 is received within latch coupling 50 in a known orientation. As best seen in FIGS. 7A-7C, wiper plug 52 includes an outer housing 102 including upper housing member 104 and lower housing member 106. Disposed exteriorly of upper housing member 104 is an upper wiper 108 that is operable to establish a sealing relationship with the interior of liner string 36 when wiper plug 52 is installed within latch coupling 50. Upper housing member 104 includes a slot 110. An alignment key 112 radially extends through slot 110 and is operable to be received within a slot profile 114 of latch coupling 50, as best seen in FIG. 2B. Slot profile 114 is preferably circumferentially oriented in a known and preferably centered relationship with primary latch profile 116 of latch coupling 50. In this manner, wiper plug 52 has a known orientation relative to at least one feature of liner string 36 and more particularly, a known orientation relative to latch coupling 50. Alignment key 112 is slidably received within a guide 118 to enable alignment key 112 to be retracted out of slot profile 114 as explained below.

Disposed exteriorly of lower housing member 106 is a lower wiper 120 that is operable to establish a sealing relationship with the interior of liner string 36 when wiper plug 52 is installed within latch coupling 50. Lower housing member 106 is operable to receive an actuator cover 122 and two electronics covers 124, 126 that may be coupled to lower housing member 106 by any suitable technique such as bolting, welding, banding or the like. Lower housing member 106 is also operable to receive an end cap 128 that may be threadedly and sealable coupled to lower housing member 106.

Disposed within upper housing member 104 is a sliding sleeve 130 that is initially secured to upper housing member 104 by a plurality of frangible members depicted as shear pins 132. Sliding sleeve 130 includes guide 118 discussed above. Disposed within one or more chambers of lower housing member 106 are the electronic components and mechanical devices that provide intelligence and communication capabilities to wiper plug 52. In the illustrated embodiment, lower housing member 106 includes a lower cylindrical chamber operable to receive a plurality of fuel cells depicted as batteries 134, such as alkaline or lithium batteries, and a battery connector 136. Even through the present embodiment has been described as including batteries 134, those skilled in the art will recognized that other power sources could alternatively be used to power wiper plug 52 including, but not limited to, an electrical line extending from the surface, a downhole power generation unit or the like.

Figure 8A:
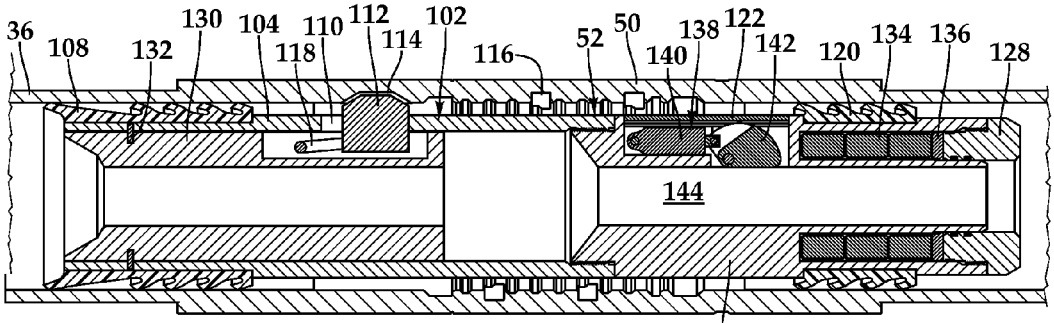
FIGS. 8A-8C are cross sectional views of a wiper plug for use in a system for determining an orientation of a casing string in a wellbore according to an embodiment of the present disclosure sending pressure pulse communications.
Figure 8B:
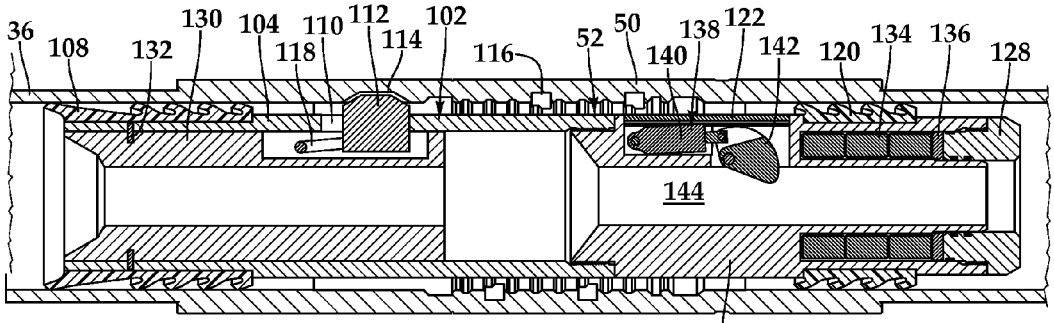
Figure 8C:
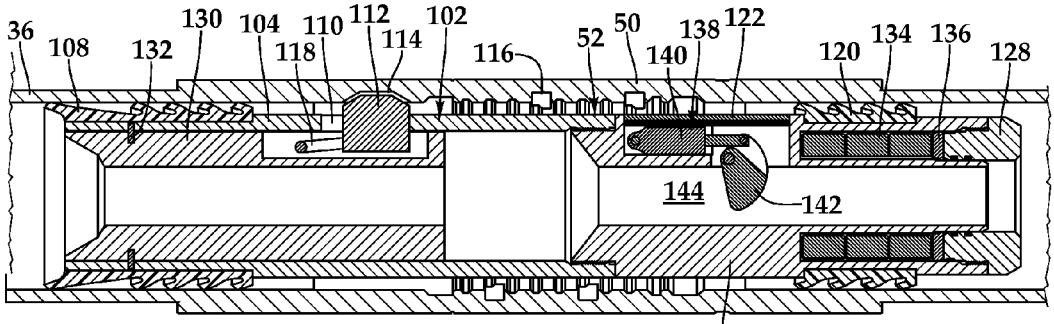

Beneath cover 122, lower housing member 106 includes a communication chamber operable to receive a communication module therein. In the illustrated embodiment, the communication module is depicted as a mud pulser 138 including an actuator 140 and a rocker arm 142 operatively coupled to actuator 140 such that movement of actuator 140 correspondingly moves rocker arm 142. Actuator 140 may be any suitable actuating device including, but not limited to, a mechanical actuator, an electromechanical actuator, a hydraulic actuator, a pneumatic actuator, combinations thereof and the like. As best seen in FIGS. 8A-8C, rocker arm 142 may be pivotably coupled to actuator 140 such that when actuator 140 is actuated, rocker arm 142 pivots into a flow path 144 centrally defined within wiper plug 52. As rocker arm 142 pivots into flow path 144, rocker arm 142 at least partially occludes flow path 144 and is thereby able to transmit pressure pulses to surface installation 54 via the fluid column present within the interior of liner string 36 and work string 44. At surface installation 54, the pressure pulses are received by one or more sensors of a computer system and are converted into an amplitude or frequency modulated pattern of the pressure pulses. The pattern of pressure pulses may then be translated by the computer system into specific information or data transmitted from mud pulser 138. Even through the present embodiment has been described as including mud pulser 138, those skilled in the art will recognized that other wireless or wired communication systems could alternatively be used to communication information to the surface including, but not limited to, a communication cable including electrical and/or optical conductors, an electromagnetic telemetry system, a mud pulser having an alternate design, an acoustic telemetry system including, for example, an acoustic receiver operably associated with surface installation 54 and any number of acoustic repeaters or nodes positioned at pre-determined locations along liner string 36 and casing string 40, combinations thereof or the like.

Beneath cover 124, lower housing member 106 includes a sensor module chamber operable to receive a sensor module 146 therein. Sensor module 146 is operable to obtain orientation information relating to the circumferential positioning of wiper plug 52 and thereby liner string 36. For example, as best seen in FIG. 9B, sensor module 146 may include one or more accelerometers depicted as a 3-axis accelerometer 148, one or more gyroscopes depicted as a 3-axis gyroscope 150 and one or more magnetometers depicted as a 3-axis magnetometer 152. In certain embodiments, sensor module 146 may be micro-electromechanical systems (MEMS), such as MEMS inertial sensors that include the various accelerometers, gyroscopes and magnetometers. In addition, sensor module 146 may comprise additional sensors including, but not limited to, temperature sensors, pressure sensors, strain sensors, pH sensors, density sensors, viscosity sensors, chemical composition sensors, radioactive sensors, resistivity sensors, acoustic sensors, potential sensors, mechanical sensors, nuclear magnetic resonance logging sensors and the like.

Beneath cover 126, lower housing member 106 includes a computer hardware chamber operable to receive a microcontroller 154 as well as other computer hardware components therein. For example, the computer hardware may be configured to implement the various methods described herein and can include microcontroller 154 configured to execute one or more sequences of instructions, programming stances, or code stored on a non-transitory, computer-readable medium. Microcontroller 154 may be, for example, a general purpose microprocessor, a digital signal processor, an application specific integrated circuit, a field programmable gate array, a programmable logic device, a controller, a state machine, a gated logic, discrete hardware components, an artificial neural network, or any like suitable entity that can perform calculations or other manipulations of data. In some embodiments, the computer hardware can further include elements such as a memory, including, but not limited to, random access memory (RAM), flash memory, read only memory (ROM), programmable read only memory (PROM), electrically erasable programmable read only memory (EEPROM), registers, hard disks, removable disks, CD-ROMS, DVDs, or any other like suitable storage device or medium.

Figure 9A:
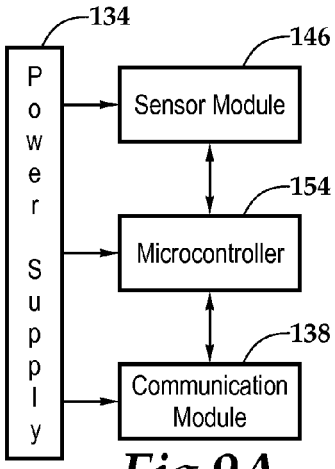
FIG. 9A is a diagram of an electronics and communication subassembly for use in a system for determining an orientation of a casing string in a wellbore according to an embodiment of the present disclosure.
Figure 9B:
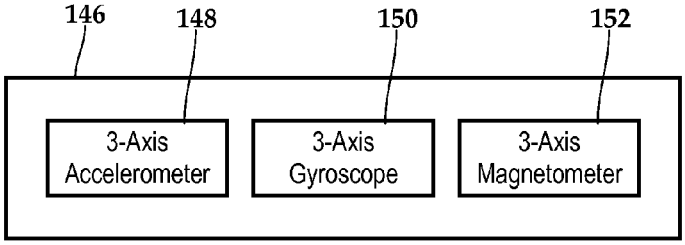
FIG. 9B is a diagram of a sensor module for use in a system for determining an orientation of a casing string in a wellbore according to an embodiment of the present disclosure.

As best seen in FIG. 9A, the measurements obtained by sensor module 146 may be conveyed in real-time or substantially in real-time to microcontroller 154, which may be configured to receive and process these measurements. In some embodiments, microcontroller 154 may be configured to store the pre-processed or processed measurements. In other embodiments, microcontroller 154 may be configured to translate the processed measurements into command signals that are transmitted to mud pulser 138. The command signals may be received by mud pulser 138 and serve to actuate mud pulser 138 such that rocker arm 142 is engaged to partially occlude flow path 144 and thereby transmit pressure pulses to surface installation 54 via the fluid column present within liner string 36 and work string 44. At the surface, the pressure pulses may be received by a computer system including one or more sensors and retranslated back into the measurement data such that the well operator may use the information to orient liner string 36.

As best seen in FIG. 2A, the upper portion of well system 100 includes lead wiper 56 and follow wiper 58. As illustrated, lead wiper 56 includes a housing element 160. Disposed exteriorly of housing element 160 is a wiper 162 that is operable to establish a sealing relationship with the interior of liner string 36. Disposed within a lower portion of lead wiper 56 is a ball seat 164 that is initially secured to housing element 160 by a plurality of frangible members depicted as shear pins 166. The lower portion of lead wiper 56 defines a fluid bypass network including openings 168, fluid passageways 170 and openings 172, the operation of which is described below. Disposed within an upper portion of lead wiper 56 is a ball seat 174 that is initially secured to housing element 160 by a plurality of frangible members depicted as shear pins 176. The upper portion of lead wiper 56 defines a fluid bypass network including openings 178, fluid passageways 180 and openings 182, the operation of which is described below.

The operation of the system for determining the orientation of a casing string in a wellbore will now be described with reference to FIGS. 2A-2B through 6A-6B. As stated above, FIGS. 2A-2B show lead wiper 56 and follow wiper 58 positioned in an upper portion of liner string 36, for example, proximate liner hanger 46 (see FIG. 1). In addition, wiper plug 52 is positioned in a lower portion of liner string 36, for example, proximate window joint 48 (see FIG. 1). After liner string 36 has been run in wellbore 38 to the positioned shown in FIG. 1 wherein the top of liner string 36 including liner hanger 46 is positioned near the bottom of casing string 40, liner string 36 now requires circumferential orientation to enable the lateral well to be drilled from the parent wellbore in the desired direction. This is achieved using the intelligence and communication capabilities of wiper plug 52. Specifically, sensor module 146 utilizes its accelerometer, gyroscope and/or magnetometer elements to determine proper orientation, for example, with respect to the Earth's gravity. Once gathered, this data may be communicated to microcontroller 154 via a suitable interface, such as a hardwire connection. Microcontroller 154 may then process the data and send command signals to mud pulser 138, which transmits the data to surface installation 54 via pressure pulses, as described above. Surface installation 54 may receive and translate the pressure pulses into data that the well operator can use to make any needed orientation adjustments of liner string 36 by rotating working string 44 at the surface. This process may take place in real-time or using an iterative, stepwise approach until the desired orientation is achieved.

During running, positioning and orienting of liner string 36 into wellbore 38, a drilling fluid may be present and may be circulated through wellbore 38 from the surface through the interior of work string 44 and liner string 36 as well as through the interior of lead wiper 56, follow wiper 58 and wiper plug 52. During fluid circulation, the drilling fluid exits the bottom of liner string 36 into the annulus surrounding liner string 36 via a float shoe and is then pumped back up toward the surface within the annulus. A check valve may be positioned within the float shoe to prevent reverse flow of the drilling fluid back into liner string 36 from the annulus.

Figure 3A:
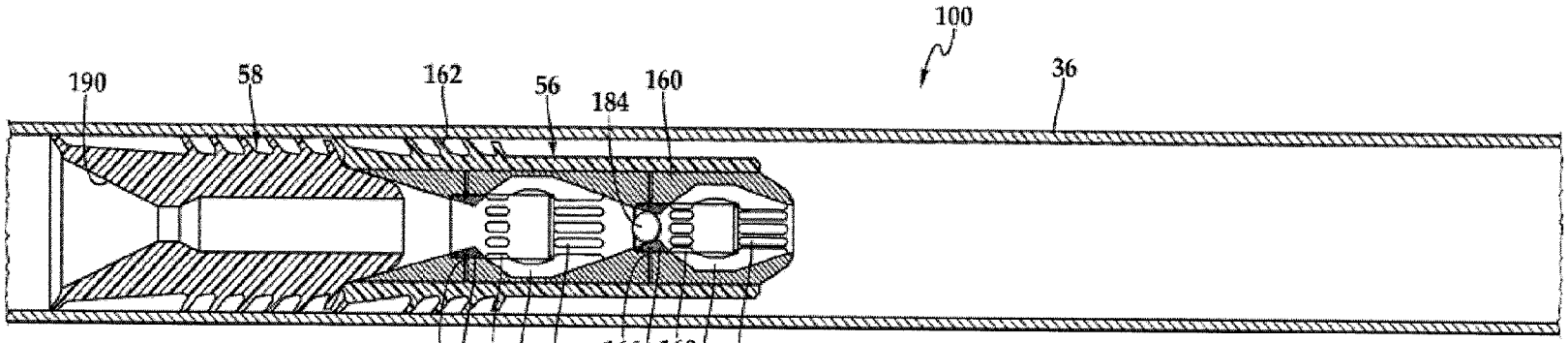
FIGS. 3A-3B are cross sectional views of a system for determining an orientation of a casing string in a wellbore according to an embodiment of the present disclosure during a liner hanging procedure.
Figure 3B:
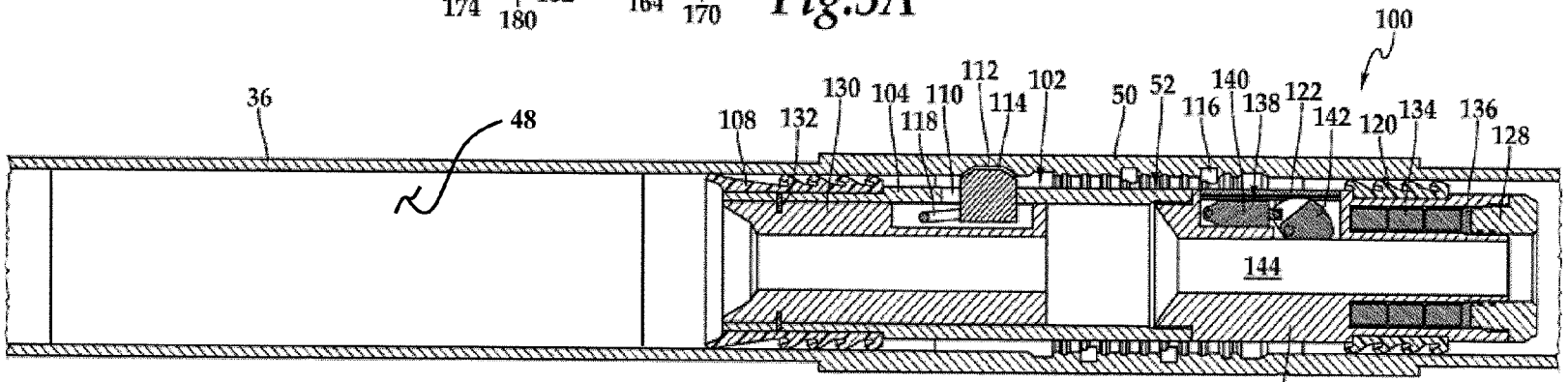
Figure 4A:
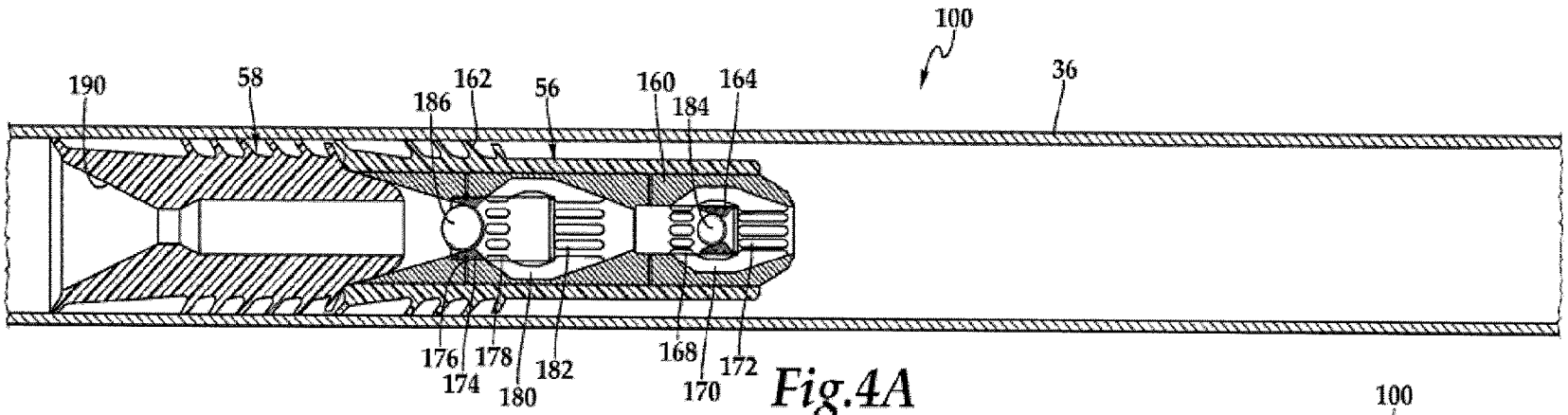
FIGS. 4A-4B are cross sectional views of a system for determining an orientation of a casing string in a wellbore according to an embodiment of the present disclosure prior to a cementing procedure.
Figure 4B:
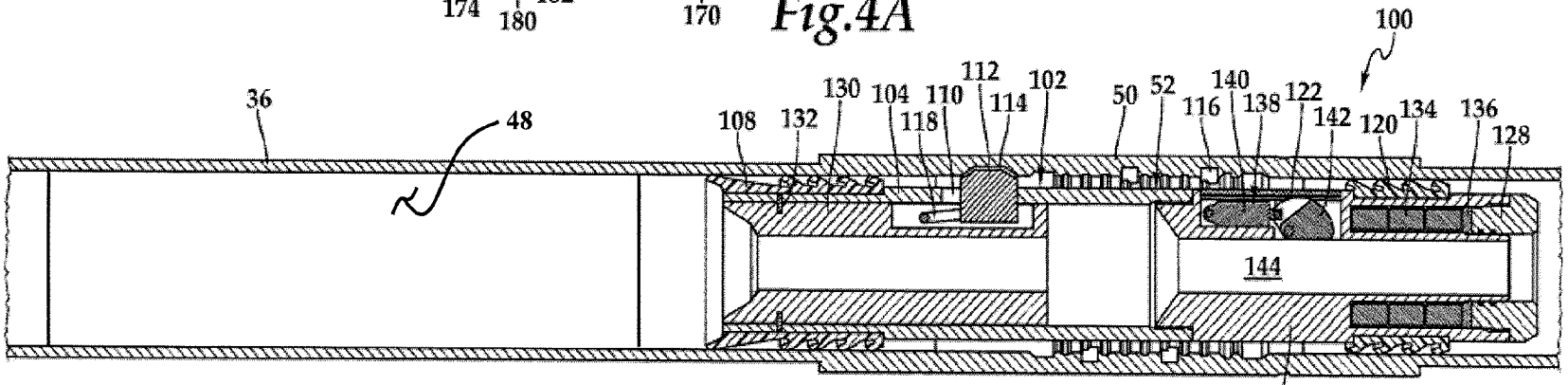

Once liner string 36 is oriented in the desired circumferential direction, liner hanger 46 may be set. As best seen in FIGS. 3A-3B, this may be accomplished by dropping a ball 184 from the surface into work string 44. By gravity feed or fluid circulation, ball 184 travels downhole to ball seat 164 of lead wiper 56. In this configuration, fluid pressure may be increase uphole of ball 184 and pressure variations in work string 44 can be used to set liner hanger 46 in a known manner. After liner hanger 46 is set, increasing the fluid pressure in work string 44 above a predetermined threshold causes ball seat 164 to shear down. In this configuration, openings 168, fluid passageways 170 and openings 172, enable fluid circulation through well system 100, as best seen in FIG. 4A. For example, a spacer fluid may be pumped into work string 44 and circulated through wellbore 38 to separate the drilling fluid from another fluid, such as the cement slurry to be circulated through wellbore 38 following the spacer fluid.

Figure 5A:
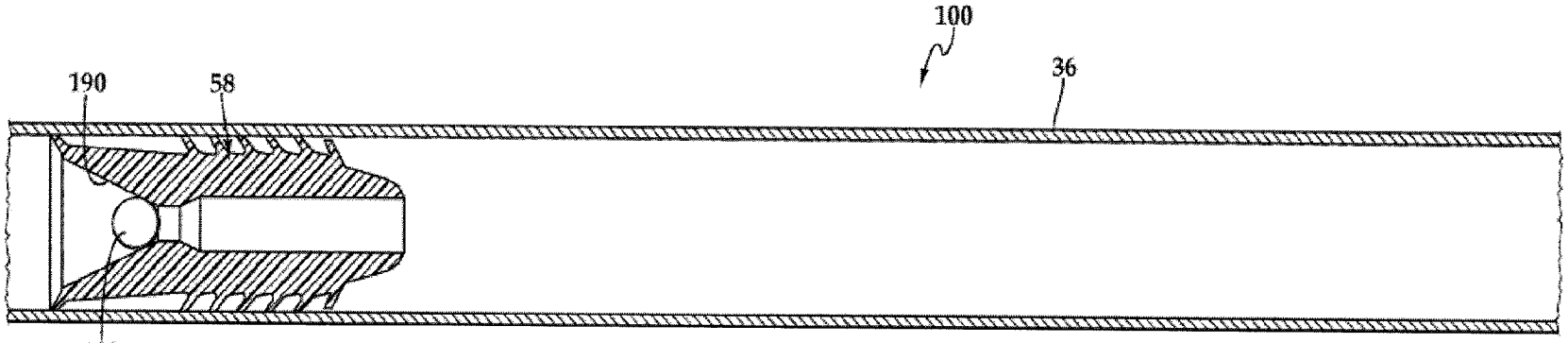
FIGS. 5A-5B are cross sectional views of a system for determining an orientation of a casing string in a wellbore according to an embodiment of the present disclosure during a cementing procedure.
Figure 5B:
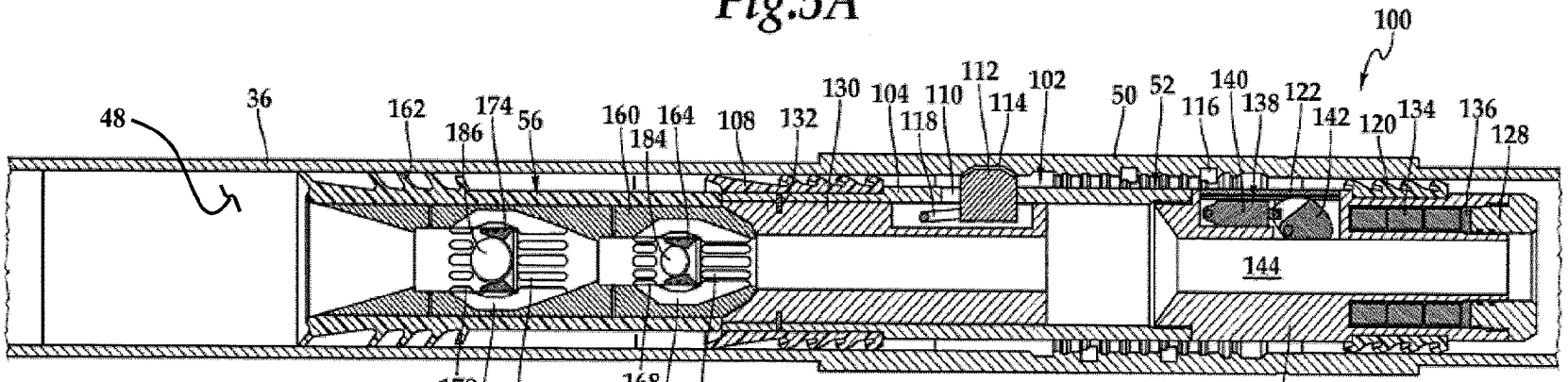

Prior to commencing the cementing operation, as best seen in FIG. 4A, a second ball 186 may be dropped from the surface into work string 44. By gravity feed or fluid circulation, ball 186 travels downhole to ball seat 174 of lead wiper 56. In this configuration, increasing the pressure uphole of lead wiper 56 by, for example, pumping the cement slurry, causes lead wiper 56 to separate from follow wiper 58. During this process, the fluid behind lead wiper 56 pushes lead wiper 56 downhole as lead wiper 56 pushes the fluid downhole thereof through wiper plug 52 and the float shoe into the annulus surrounding liner string 36 and back up toward the surface. The process continues until lead wiper 56 reaches wiper plug 52, as best seen in FIG. 5B. Thereafter, increasing the fluid pressure in work string 44 above a predetermined threshold causes ball seat 174 to shear down. In this configuration, openings 178, fluid passageways 180 and openings 182, enable fluid circulation through well system 100, also as best seen in FIG. 5B. The cement slurry may be circulated through wiper plug 52 and the float shoe into the annulus surrounding liner string 36 and back up toward the liner top.

Figure 6A:
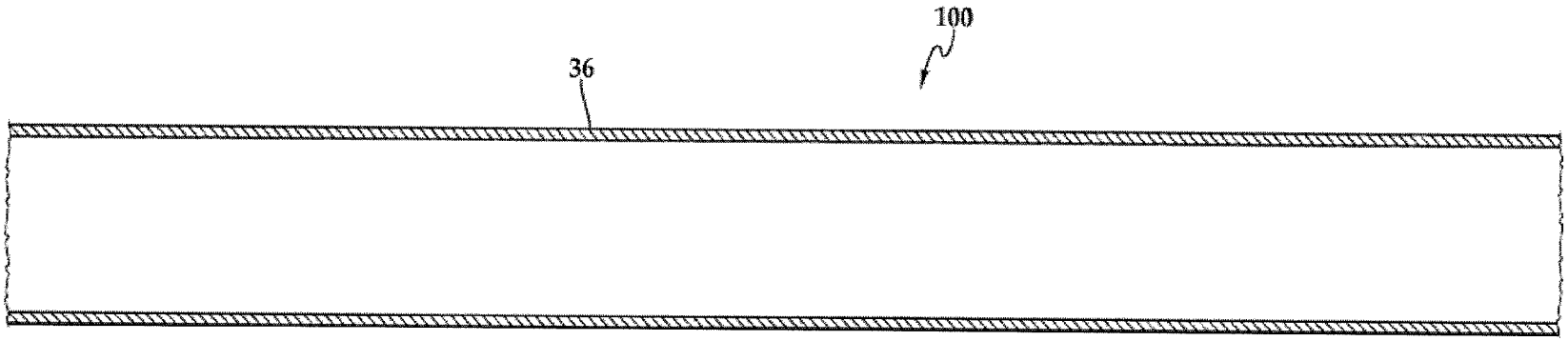
FIGS. 6A-6B are cross sectional views of a system for determining an orientation of a casing string in a wellbore according to an embodiment of the present disclosure during a releasing procedure.
Figure 6B:
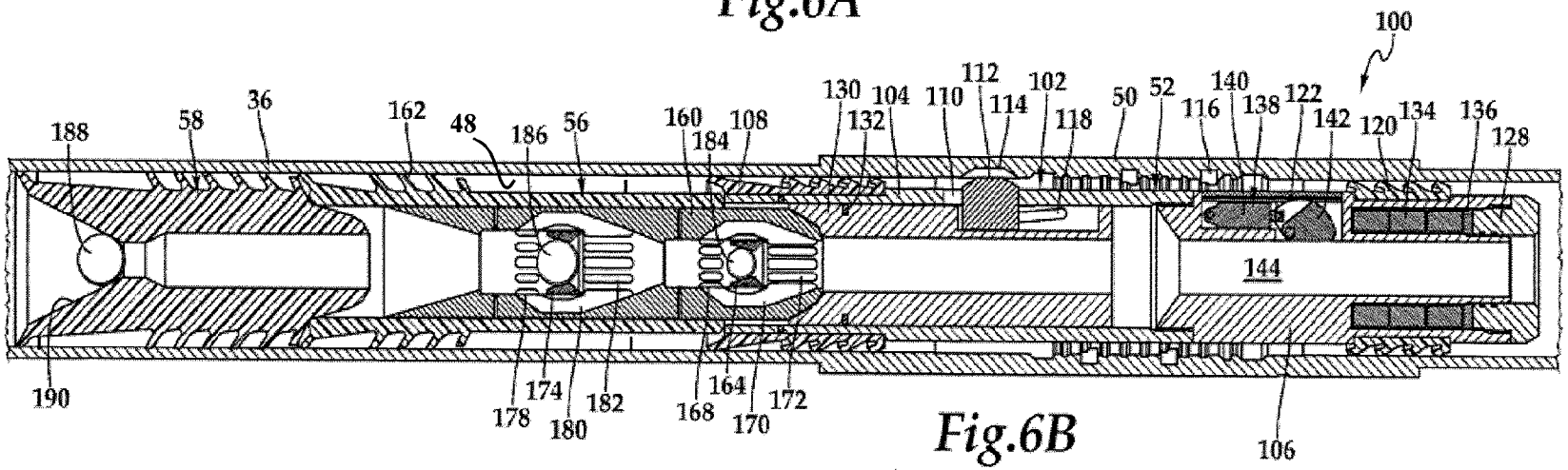

After the desired volume of cement has been pumped into wellbore 38, another spacer fluid may be pumped down work string 44 behind the cement slurry. A third ball 188 may now be dropped from the surface into work string 44. By gravity feed or fluid circulation, ball 188 travels downhole to ball seat 190 of follow wiper 58. In this configuration, increasing the pressure uphole of follow wiper 58 by, for example, pumping the spacer fluid, causes follow wiper 58 to move downhole enabling follow wiper 58 to push the fluid and/or cement downhole thereof through wiper plug 52 and the float shoe into the annulus surrounding liner string 36 and back up toward the liner top. This process continues until follow wiper 58 reaches lead wiper 56, as best seen in FIG. 6B. Thereafter, increasing the fluid pressure in work string 44 above a predetermined threshold causes follow wiper 58 to act on lead wiper 56 and thereby causes lead wiper 56 to act on sliding sleeve 130 of wiper plug 52. This action cause shear pins 132 to break, which enables sliding sleeve 130 to move downhole relative to upper housing member 104. This causes alignment key 112 to radially retract from slot profile 114. Thereafter, fluid pressure acting on ball 188 pushes follow wiper 58, lead wiper 56 and wiper plug 52 downhole into contact with the float shoe. When desired, the end of liner string 36 may be drilled out to allow the installation of, for example, mainbore screens. In this case, follow wiper 58, lead wiper 56 and wiper plug 52 are preferably formed from materials that are easily millable or drillable such ceramics, aluminum, polymers or the like.

It should be understood by those skilled in the art that the illustrative embodiments described herein are not intended to be construed in a limiting sense. Various modifications and combinations of the illustrative embodiments as well as other embodiments will be apparent to persons skilled in the art upon reference to this disclosure. It is, therefore, intended that the appended claims encompass any such modifications or embodiments.

What is claimed is:

1. A system for determining a circumferential orientation of a casing string relative to a wellbore in which the casing string extends, the system comprising:

a latch coupling interconnected in the casing string and having a fixed circumferential orientation relative thereto, wherein the latch coupling and the casing string are together permitted to rotate relative to the wellbore;

a wiper plug received and maintained within the latch coupling in a known circumferential orientation relative to the casing string;

a sensor module operably associated with the wiper plug and configured to obtain data relating to the circumferential orientation of the wiper plug and thus the circumferential orientation of the latch coupling together with the casing string, relative to the wellbore; and a communication module operably associated with the sensor module, the communication module configured to transmit information to a surface location, wherein the information corresponds to the data obtained by the sensor module relating to the circumferential orientation of the wiper plug, the latch coupling, and the casing string, relative to the wellbore.

2. The system as recited in claim 1 further comprising a window joint interconnected in the casing string in a known circumferential orientation relative to the latch coupling.

3. The system as recited in claim 1 wherein the sensor module further comprises at least one of an accelerometer, a gyroscope and a magnetometer.

4. The system as recited in claim 1 further comprising a microcontroller operably associated with the sensor module and the communication module.

5. The system as recited in claim 1 further comprising a power supply operably associated with the sensor module and the communication module.

6. The system as recited in claim 1 wherein the communication module further comprises a pulser configured to transmit pressure pulses to the surface location.

7. A system for determining a circumferential orientation of a casing string relative to a wellbore in which the casing string extends, the system comprising:

a latch coupling interconnected in the casing string and having a fixed circumferential orientation relative thereto, wherein the latch coupling and the casing string are together permitted to rotate relative to the wellbore;

a wiper plug received and maintained within the latch coupling in a known circumferential orientation relative to the casing string;

a sensor module disposed within the wiper plug, the sensor module including at least one of an accelerometer, a gyroscope, and a magnetometer configured to obtain data relating to the circumferential orientation of the wiper plug and thus the circumferential orientation of the latch coupling together with the casing string, relative to the wellbore;

a communication module operably associated with the sensor module, the communication module configured to transmit information to a surface location, wherein the information corresponds to the data obtained by the sensor module relating to the circumferential orientation of the wiper plug, the latch coupling, and the casing string, relative to the wellbore;

a microcontroller operably associated with the sensor module and the communication module; and a power supply operably associated with the sensor module, the communication module and the microcontroller.

8. The system as recited in claim 7 further comprising a window joint interconnected in the casing string in a known circumferential orientation relative to the latch coupling.

9. The system as recited in claim 7 wherein the sensor module further comprises at least one of a three-axis accelerometer, a three-axis gyroscope and a three-axis magnetometer.

10. The system as recited in claim 7 wherein the communication module further comprises a pulser configured to transmit pressure pulses to the surface location.

11. The system as recited in claim 7 wherein the wiper plug sealingly engages the casing string uphole and downhole of the latch coupling.

12. The system as recited in claim 7 wherein the wiper plug releasably engages the latch coupling.

13. The system as recited in claim 7 wherein the wiper plug further comprises a drillable wiper plug.

14. A method for circumferentially orienting a casing string relative to a wellbore in which the casing string extends, the method comprising:

providing a latch coupling interconnected in the casing string and having a fixed circumferential orientation relative thereto, wherein the latch coupling and the casing string are together permitted to rotate relative to the wellbore;

receiving and maintaining a wiper plug within the latch coupling in a known circumferential orientation relative to the casing string;

sealingly engaging the casing string uphole and downhole of the latch coupling with the wiper plug;

obtaining, using a sensor module operably associated with the wiper plug, data relating to the circumferential orientation of the wiper plug and thus the circumferential orientation of the latch coupling together with the casing string, relative to the wellbore;

transmitting information to a surface location using a communication module operably associated with the sensor module, the information corresponding to the data obtained by the sensor module relating to the circumferential orientation of the wiper plug, the latch coupling, and the casing string, relative to the wellbore; and orienting the wiper plug, the latch coupling, and the casing string to a desired circumferential orientation relative to the wellbore based upon the information received from the communication module at the surface location.

15. The method as recited in claim 14 wherein obtaining the data relating to the circumferential orientation of the wiper plug, the latch coupling, and the casing string, relative to the wellbore, further comprises obtaining the data with at least one of an accelerometer, a gyroscope, and a magnetometer.

16. The method as recited in claim 14 wherein transmitting the information corresponding to the data obtained by the sensor module to the surface location with the communication module operably associated with the sensor module further comprises transmitting pressure pulses to the surface location.

17. The method as recited in claim 14 wherein, after orienting the wiper plug, the latch coupling, and the casing string to the desired circumferential orientation relative to the wellbore based upon the information received from the communication module at the surface location, the method further comprises destructively removing the wiper plug from the casing string.

* * * * *